US006484450B1

(12) United States Patent
Suprina et al.

(10) Patent No.: US 6,484,450 B1
(45) Date of Patent: Nov. 26, 2002

(54) DEMOUNTABLE INDOOR/OUTDOOR SEATING SYSTEM COMPONENTS

(76) Inventors: Scott Suprina, 26 Parkway Dr. South, Commack, NY (US) 11725; Tony English, 28 Royal Oak Dr., Huntington, NY (US) 11743; John Moreby, 788 Alderbrook Road, Solihull West Midlands B98 1NR (GB)

( * ) Notice: Subject to any disclaimer, the term of this patent is extended or adjusted under 35 U.S.C. 154(b) by 68 days.

(21) Appl. No.: 09/710,470

(22) Filed: Nov. 9, 2000

(51) Int. Cl.[7] ..... E04H 3/12

(52) U.S. Cl. ..... 52/8; 52/184; 52/9; 52/126.6; 297/35; 297/217.7; 248/161

(58) Field of Search ..... 52/8, 6, 9, 126.4, 52/126.6; 403/109.1, 109.6, 109.5, 373, 374.1, 374.2, 374.3, 374.4

(56) References Cited

U.S. PATENT DOCUMENTS

| | | | | | |
|---|---|---|---|---|---|
| 3,443,835 | A | * | 5/1969 | Brunskole | 297/35 |
| 3,808,757 | A | * | 5/1974 | Greenwood | 52/184 |
| 4,412,403 | A | * | 11/1983 | LeFranc et al.. | 52/9 |
| 4,831,797 | A | * | 5/1989 | Vladikovic | 52/126.6 |
| 5,385,323 | A | * | 1/1995 | Garelick | 248/161 |
| 5,960,589 | A | * | 10/1999 | Youngquist et al. | 52/8 |
| 6,244,657 | B1 | * | 6/2001 | Momose | 297/217.7 |

FOREIGN PATENT DOCUMENTS

| | | | |
|---|---|---|---|
| GB | 2229089 A | 9/1990 | A47C/3/04 |
| GB | 2229205 A | 9/1990 | E04H/3/12 |
| GB | 2229217 A | 9/1990 | F16B/21/16 |

* cited by examiner

*Primary Examiner*—Carl D. Friedman
*Assistant Examiner*—Steve Varner
(74) *Attorney, Agent, or Firm*—Alfred M. Walker

(57) ABSTRACT

A demountable indoor/outdoor arena seating system includes a plurality of seat groups in seating modules. The seat group modules are supported by a plurality of floor board deck members of joined planks, wherein the deck members have attachment extensions attachable to the seat group modules. The deck members are supported by inner struts insertable in outer hollow struts. The inner struts are grooved to accommodate the heads of shortened locking bolts having spring loaded cam rings to lock the bolts in place.

20 Claims, 9 Drawing Sheets

DEMOUNTABLE INDOOR/OUTDOOR SEATING SYSTEM COMPONENTS

FIELD OF THE INVENTION

The present invention relates to stable yet easily demountable modular seating systems.

BACKGROUND OF THE INVENTION

Temporary, demountable seating systems for indoor and, outdoor arenas are known. For example, classic bleacher seating systems include continuous horizontal seating boards, which are arranged in a sloped orientation, with the seating boards farther away, being incrementally higher than the next lower level seating boards. Upright stud framing holds the seating boards, interspersed with parallel, incrementally positioned floorboards. To prevent falling at the edges of the bleacher seating, handrail banisters are provided.

The drawbacks for bleacher seating include the fact that flat seats without backrests are generally uncomfortable, especially for events of several hours or more. In addition, the floorboards may shake, creating uncomfortable vibrations for adjacent seated customers, with undesirable noise.

Furthermore, the side rail banisters are sometimes chain link or a horizontal configuration of rails that are climbable and loose, and they must be of a sturdy construction to provide sufficient lateral support to prevent falling.

Attempts have been made to provide temporary indoor seating systems with groups of seats, typically three, with backs rests, that are joined to a framework. However, the attachments for such systems are inconvenient to remove and reinstall. In addition, these indoor seating systems are not made for outdoor use.

Moreover, in existing seating systems, in order to prevent lateral deflection, the tubular cylindrical posts supporting rails need complicated fasteners, and cannot be simply dropped in place and secured. Also, to provide this support in a vertical picket for the rail, other attempts are made of steel construction.

In addition, tubular, cylindrical handrails can be easy to lose hold of, especially when wet from exposure to recent rain or morning dew.

Furthermore, the deck panels in existing seating systems need external strut supports.

In addition, existing seating systems often require motorized lift access to be erected, which is especially difficult to provide in remote outdoor amphitheater grandstand arenas or in inner city indoor theater spaces requiring the erection of seats from scratch.

Assembly of the seating components is also difficult in outdoor conditions, where dirt can get into apertures in cam-operable locking bolts and their respective slot receptacles, preventing the automatic locking by gravity pull against locking rotating rings. These prior art locking bolts do not have any internal force mechanisms to assist gravity in deflecting the rotating rings of the locking bolts.

Furthermore, often the vertical posts of a seating frame are square in cross section, with too small a transverse, horizontal clearance to fit a full prior art locking bolt therethrough. Previous rails are steel.

Another problem with outdoor seating systems is the fact that jacks must be used to adjust the deploying of structural frame supports on irregular outdoor terrain. Since the jacks have vertically extending members engage with other vertically extending posts, there is a need to provide simple fasteners which can securely lock the posts to the jack supports, and offer bracing locations when the jacks are extended.

Another problem with existing outdoor seating systems is that the modular groups of seats with backrests need to be firmly attached to the supporting framework, yet they must also be quickly disassembled, two tasks which are difficult to achieve together.

Finally, outdoor decks to walk on can be noisy if the joints are loose, or can be uncomfortable if they are walked on, and unless they are continuous, users can trip on joining seamed surfaces. It is not a flexible system.

OBJECTS OF THE INVENTION

It is therefore an object of the present invention to provide an easily demountable arena seating system in a modular design to facilitate numerous reconfigurations.

It is another object to provide a sturdy framework for modular arena seating that minimizes noise and vibrations.

It is yet another object to provide a modular arena seating system, which is quickly assembled and disassembled and which contains seats with backs.

It is a further object to provide safety railings for arena seating which are easy to install, are not climbable and which are light weight for ease of assembly, such as being made of aluminum.

It is yet another object to provide locking bolts for modular seating systems, which are spring-loaded to facilitate locking and unlocking of the bolts and to maintain vandal proof integrity.

It is also an object to provide fasteners for assembling seating arena framework structures wherein the fasteners can be utilized in areas of small clearances without using the entire pin assembly.

It is yet another object of the present invention to improve over the disadvantages of the prior art arena seating systems.

SUMMARY OF THE INVENTION

In keeping with these objects and others which may become apparent, the present invention includes a sturdy modular arena seating system with comfortable flip-up backrest seats, which can be easily assembled and disassembled and reconfigured.

The floor board decks of the framework of the arena seating system of the present invention are constructed to minimize noise and vibrations when walked upon. For example, the deck includes hollow metal planks, such as aluminum planks, which have fitted edge extrusions that are attached thereto to lock in place. When locked together, the assembled adjacent planks form a continuous walking surface with minimal deflection when the weight of a person walks thereon. As a result, the floor board decks are quiet and do not vibrate excessively of flex, thus preventing uncomfortable vibrations to the occupants of nearby seats.

The floor board decks are attached to a structural framework of struts, and the framework holds modular groups of chairs with backrests in a tight position, thus reducing any discomfort to the occupants of the seats and becoming modular in design. Each section of chairs has upper and lower bottom attachment flanges which are aligned with grooves in the respective protruding extrusions of the adjacent floor board decks.

For example, an upper flange on the rear of the seat module is inserted in a groove of a front attachment extrusion of the upper floor deck adjacent to the bottom of the seat cushion area. In addition, a lower flange also on the rear of the seat module is inserted in a groove of the rear attachment extrusion of the next lower floor deck adjacent to the bottom of the seating module. This next lower floor deck is the deck for the feet of the arena patron sitting in the chair of the seating module.

These modular seating groups of chairs are kept in place by spring loaded fasteners for temporary seating systems, or for permanent seating groups of chairs, by more permanent vandal resistant fasteners, such as button cap screws, which are threaded through a tapped fixing plate and a threaded barrel.

The upper post struts of the supporting framework are insertable in further lower hollow post struts, and are secured in place by unique fasteners, including spring loaded locking bolts. To accommodate the insertion and fastening of an upper strut post within another lower strut post, the upper inner strut posts have longitudinally extended grooves to accommodate fastener heads connecting the upper and lower strut posts.

Furthermore, for safe guardrails, upright pickets are provided in special polygonal cross sectional sections of aluminum to maintain light weight design, such as hexagons having one longitudinally extending axis longer than a transverse axis. Such a guardrail picket configuration minimizes lateral deflection, especially from a person leaning against the guardrail. The polygonal cross section also prevents loosening by rotation associated with prior art cylindrical handrail posts set in hollow cylindrical fittings. Moreover, the horizontal handrails of the banister have ergonomically designed configurations in cross section, such as with linearly extending grooves and elevations, which provide undulating surface texturing, which are easier to hold onto than tubular cylindrical handrails.

BRIEF DESCRIPTION OF THE DRAWINGS

The present invention can best be understood in conjunction with the accompanying drawings, in which.

DETAILED DESCRIPTION OF THE INVENTION

This invention describes a number of related components for use in creating an indoor/outdoor seating system, which can be assembled, disassembled and reconfigured efficiently while providing an attractive, safe and comfortable seating area, keeping code compliant in each configuration for a wide variety of spectator events indoors and out.

It is a highly modular system, which achieves maximum benefit through the use of novel aluminum extrusions and tamper resistant quick attachment locking bolts and studs. The structural members, decking and seat modules are optimally designed to be handled efficiently by a small crew who can hand carry the sections, if necessary, to areas where motorized access is not available.

A key component which facilitates easy assembly and disassembly is the locking bolt.

Figure 1:
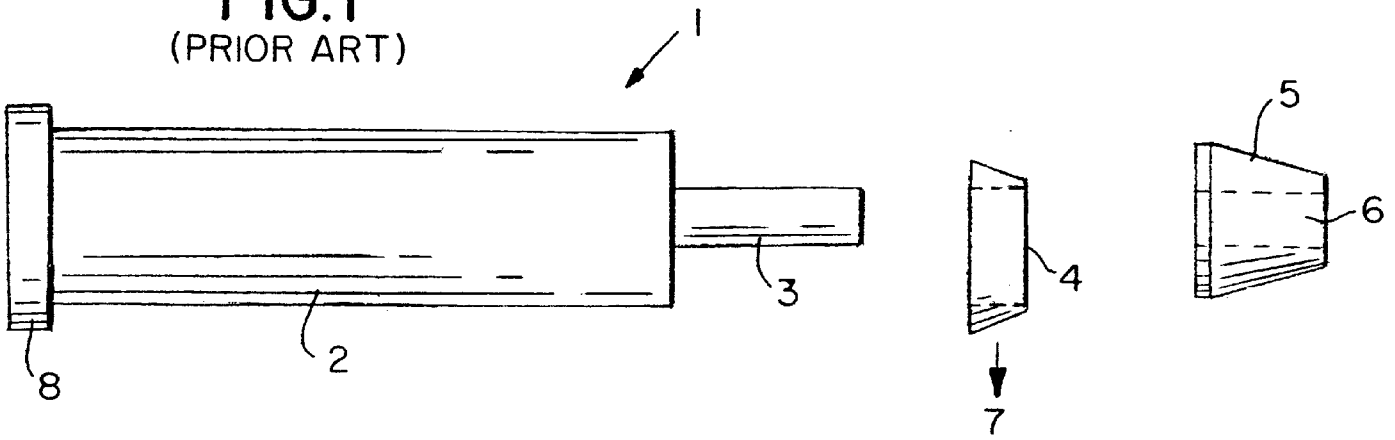
FIG. 1 (PRIOR ART)
FIG. 1 is an exploded side elevational view of a prior art locking bolt.

FIG. 1 shows a prior art version of locking bolt 1 with shaft 2, flange 8, front extension 3, rotating ring cam 4 and tapered end cap 5. This type of bolt is driven through two telescoping sections of framing with holes aligned and fastened with the aid of a simple alignment tool (not shown). After the tool is withdrawn, rotating cam ring 4 drops out of concentricity by the action of gravity (direction shown as 7) thereby locking the bolt in place and preventing its withdrawal. For removal, the same alignment tool as used in assembly is used again to force rotating ring 4 back into alignment thereby facilitating easy withdrawal. Locking bolt 1 is assembled by press fit of extension 3 inside end cap 5 bore 6 with care to insure that locking ring 4 is free to turn and move radially. Bolt 1 works well when the beam sections are well aligned and in good clean condition. However, in field conditions, the beam sections are not always clean nor are their surfaces smooth. Dirt sometimes enters the groove formed by shaft 2 and end cap 5 interfering with easy movement of rotating ring 4. These field conditions sometimes conspire to prevent the small force of gravity from forming the crucial crescent shaped locking overlap of rotating cam 4 after the alignment tool is withdrawn.

Figure 2:
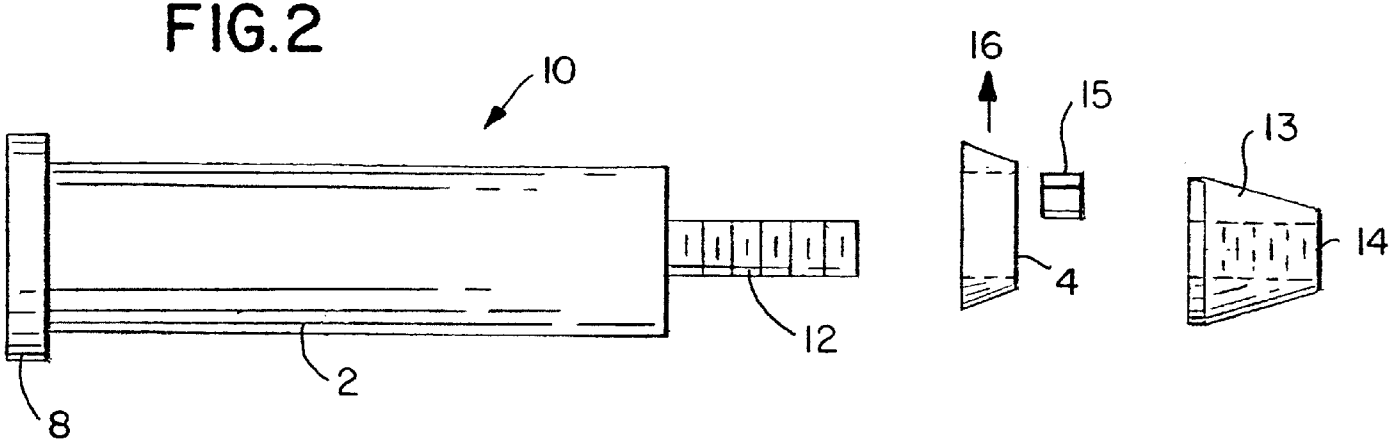
FIG. 2 is an exploded side elevational view of the locking bolt of this invention.

Locking bolt 10 of this invention, as shown in FIG. 2, alleviates the problem by providing a force much larger than gravity to move rotating cam ring 4 out of alignment with shaft 2. A small spring 15 made of a short length of nylon which is folded provides this force which moves ring 4 in direction 16 in FIG. 2.

Figure 3:
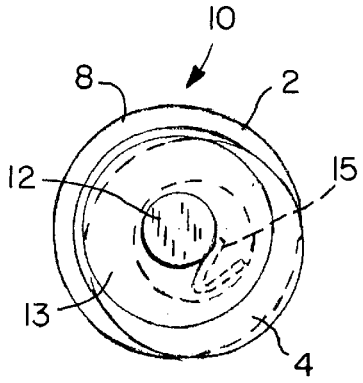
FIG. 3 is an end view of the locking bolt as in FIG. 2.

The end view of FIG. 3 shows more clearly how one leg of spring 15 bears against threaded extension 12 while the other leg bears against the inner surface of the center hole in ring 4. Locking bolt 10 is assembled by threading end cap 13 (using threads 14) onto threaded extension 12 instead of the press fit operation of prior art bolt 1. This more easily facilitates the insertion of spring 15; a high strength thread locking compound is used during assembly.

Figure 4:
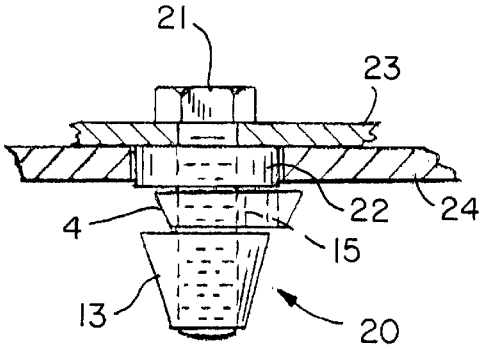
FIG. 4 is a side elevational view of a locking stud of the present invention.

In some cases, such as attaching braces and ties, it is desired to provide a quick connect to just one surface of material as opposed to a long bolt going through two surfaces of a hollow member. For these situations, the locking stud 20 as shown in FIG. 4 has been developed. A standard bolt 21 of appropriate length is permanently attached to an inner member 23 by threading a short round shaft member 22. A rotating ring cam 4 is then slipped over the bolt along with spring 15. Cap 13 is then screwed over the end of bolt 21. This permanent attachment is performed in the factory using high strength thread lock compound. One surface 24 of a brace or tie is then attached to member 23 by using the same alignment tool as for bolt 10.

Figure 5:
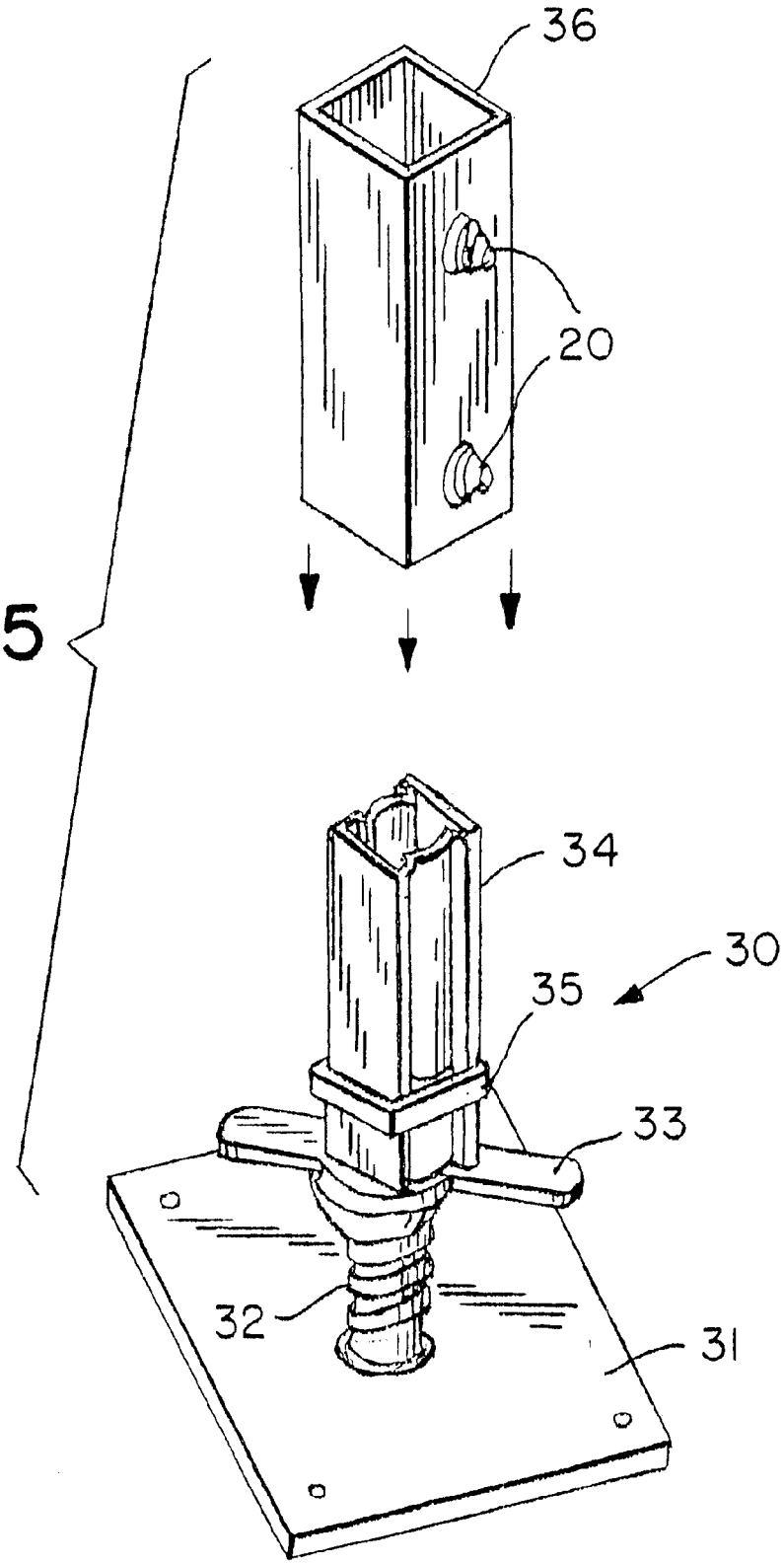
FIG. 5 is an isometric view of a frame strut supporting base jack, with extensions, of the present invention.

FIG. 5 shows a base jack 30 with base flange 31, welded screw 32, jack nut 33, leg extension 34, welded resting collar 35 and a short extension sleeve 36.

Figure 6:
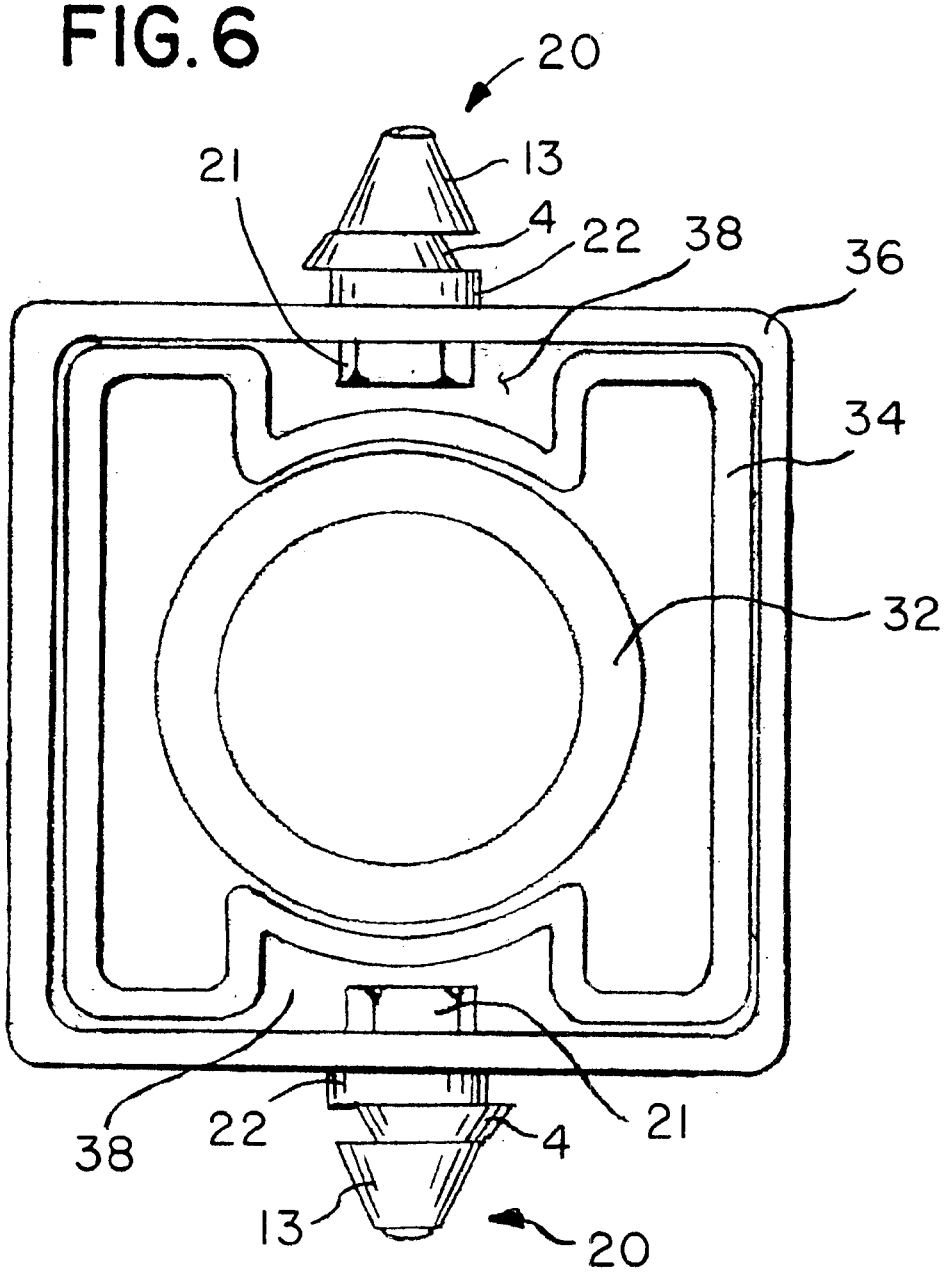
FIG. 6 is a top end view of an extension sleeve on the jack as in FIG. 5.

FIG. 6 is a top view showing the fit of the various parts within extension sleeve 36. Jacks 30 are key elements of the entire seating structure permitting alignment with irregular terrain features. In use, an extension sleeve 36, which may be much longer than shown, is rested on collar 35 which is then height adjusted by jack nut 33. Besides locking studs 20, extension 36 can have through holes either on the same surfaces as studs 20 (i.e. between them) or at right angles to these surfaces (either aligned with or between studs 20). The through holes would be used for major beam attachments using locking bolts 10 while studs 20 would be used for attachments of braces or ties. The heads of bolts 21 easily clear leg extension 34 due to its purposeful extrusion contour.

Figure 7:
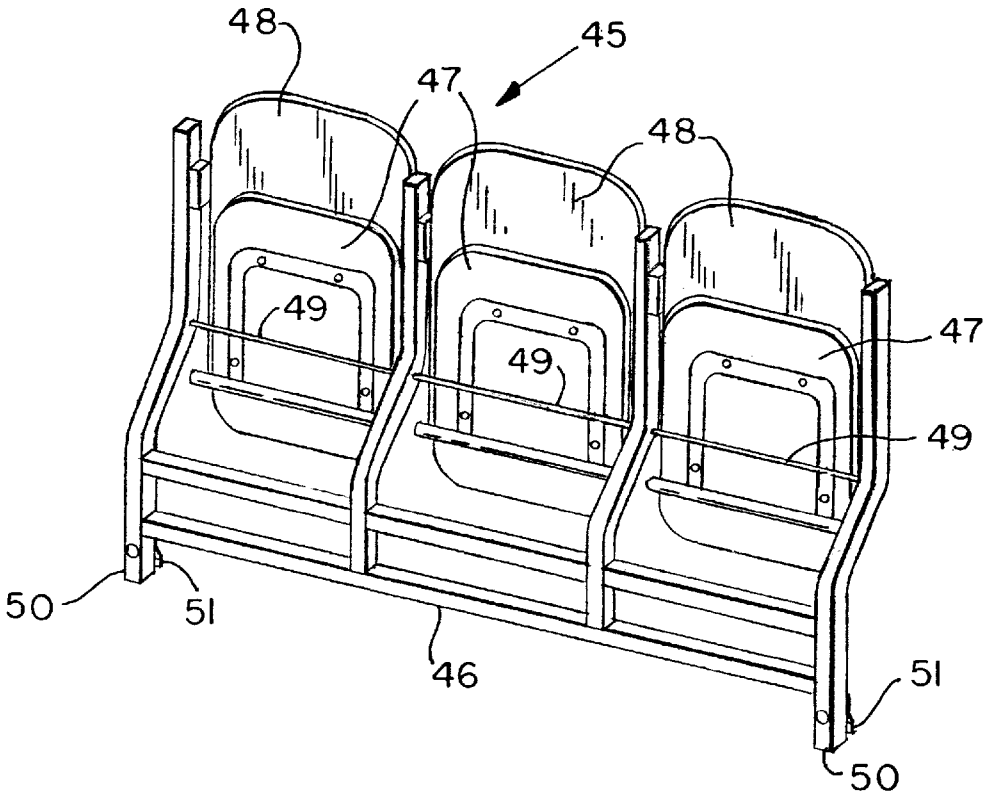
FIG. 7 is an isometric view of the three-seat module attached with the components of the present invention.

FIG. 7 shows a three seat module 45 whose structure is a welded one-piece frame 46. Modules with 2 or more seats are practical. The three seat module 45 is easily handled by one worker. Flip-up seats using either gravity or a coil spring pivot on shafts 49 to lie flush with seat backs 48. The lower ends 50 of frame 46 have a welded attachment flange 51 and a hole for mounting to the structure. While conventional construction requires a 36" wide deck between seating rows with chairs with backs, the automatic flip-up design of the seating modules insures the requisite 12" walk-through clearance with only 30" wide decks. The use of factory-attached seats in modules reduces the labor involved in attaching or detaching seats since each module, as opposed to each seat, has two attachment points. This prevents unauthorized movement and guarantees code compliance of the seating.

Figure 8:
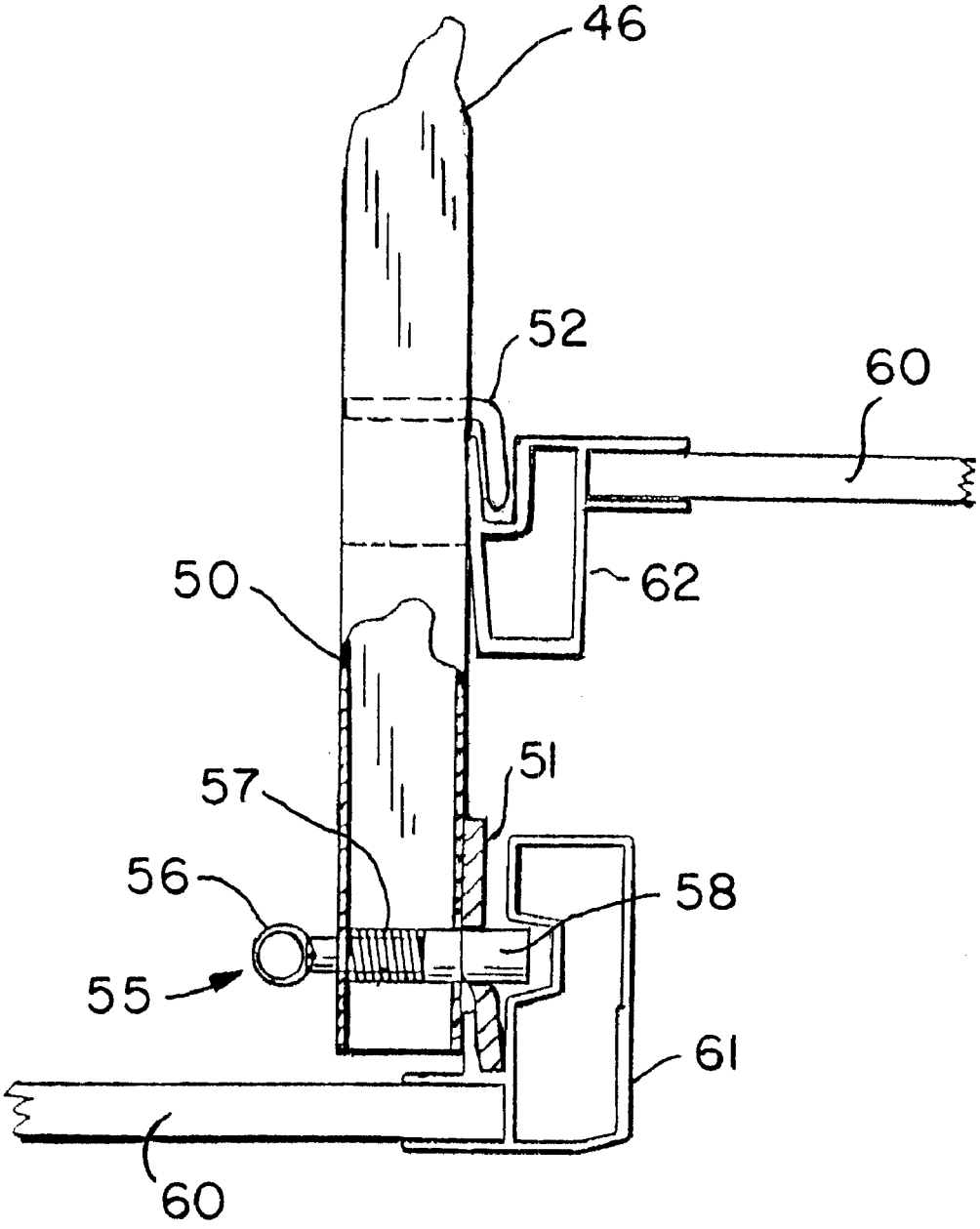
FIG. 8 is a side view detail of a removable seat attachment of the present invention.

FIG. 8 is a detail of the bottom end 50 of frame 46 showing a removable locking method and construction. A spring pin 55 consisting of key ring 56, return spring 57 and turned pin 58 is attached inside the bottom hole. The seat module section 45 is fitted so that bottom attachment flange 51 is aligned with the groove in rear deck extrusion 61; keyring 56 is pulled and frame 46 is simultaneously dropped into the groove in rear extension 61 and the top attachment tab 52 is inserted into the groove in the front extrusion 62 of the upper deck panel 60. (Frame 46 also has another attachment tab—not shown—higher than tab 52; this is used instead if a higher rise per row for the seats is desired.) When keyring 56 is released, the seating module 45 is locked in place. Removal is a simple lift while keyring 56 is pulled.

Figure 9:
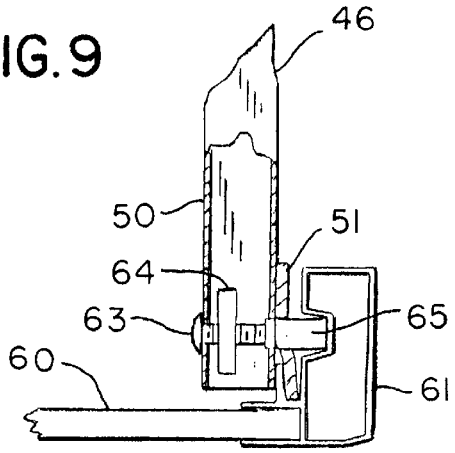
FIG. 9 is a side elevational view detail of a permanent seat attachment of the present invention.

For a permanent installation, or one which is more vandal resistant, the hardware of FIG. 9 is used as an alternative. Spring pin 55 is replaced by a button cap screw 63 which is threaded through a tapped fixing plate 64 and a threaded barrel 65 at its end. The length of cap screw 63 and barrel 65 is selected such that when torqued down with an allen wrench, seating module 45 is securely locked in the groove of rear deck extrusion 61. Removal of module 45 requires the use of an allen wrench to loosen cap screw 63. Cap screw 63, tapped fixing plate 64 and threaded barrel 65 are assembled prior to installation. Note, this locking method locks the deck down as well as the seat.

Figure 10:
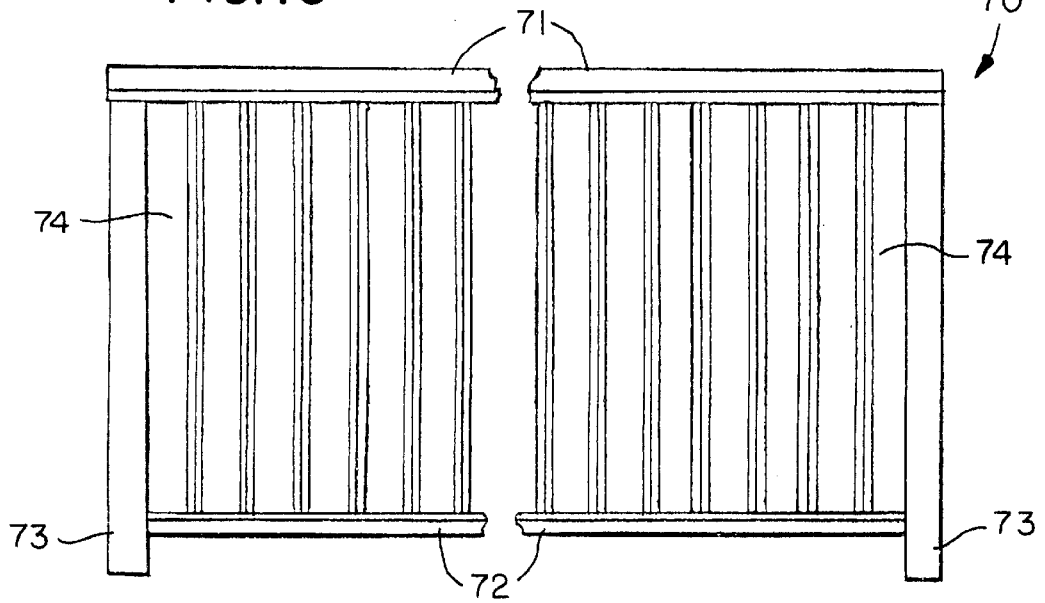
FIG. 10 is a side elevational view of the safety railing section of the present invention.

FIG. 10 shows a section of safety railing 70 that is designed for a quick and easy drop-in attachment to rigidly bolted side supports (not shown). Railing 70 consists of an aluminum weldment of a number of picket elements 74, round end tubes 73, bottom rail 72 and handrail 71. All components are extrusions. The bottom ends of tubes 73 drop into round receptacles.

Figure 11:
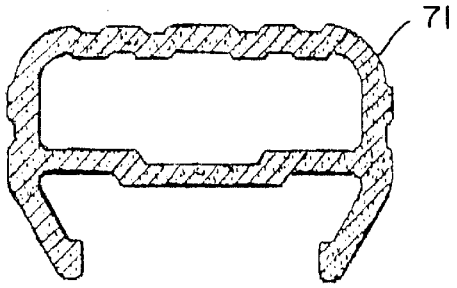
FIG. 11 shows a guardrail extrusion of the present invention, as viewed in cross section.

The cross section of handrail 71 shown in FIG. 11 is ergonomically designed for easy gripping.

Figure 12:
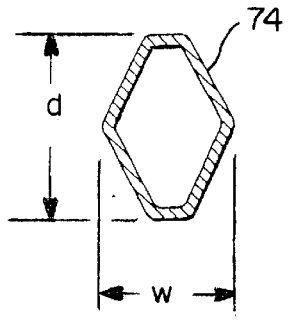
FIG. 12 depicts a handrail support picket extrusion of the present invention, as shown in cross section.

The cross section of the picket members 74 shown in FIG. 12 is carefully designed to resist bending or denting from side impacts (notice narrow flats). The longer depth dimension d and narrower width w combine to provide the desired bending moment resistance in a profile that requires significantly less material thickness than a member of round cross section of equivalent strength. This results in less weight for easier handling during construction or tear-down since the pickets are preferably manufactured of aluminum.

Figure 13:
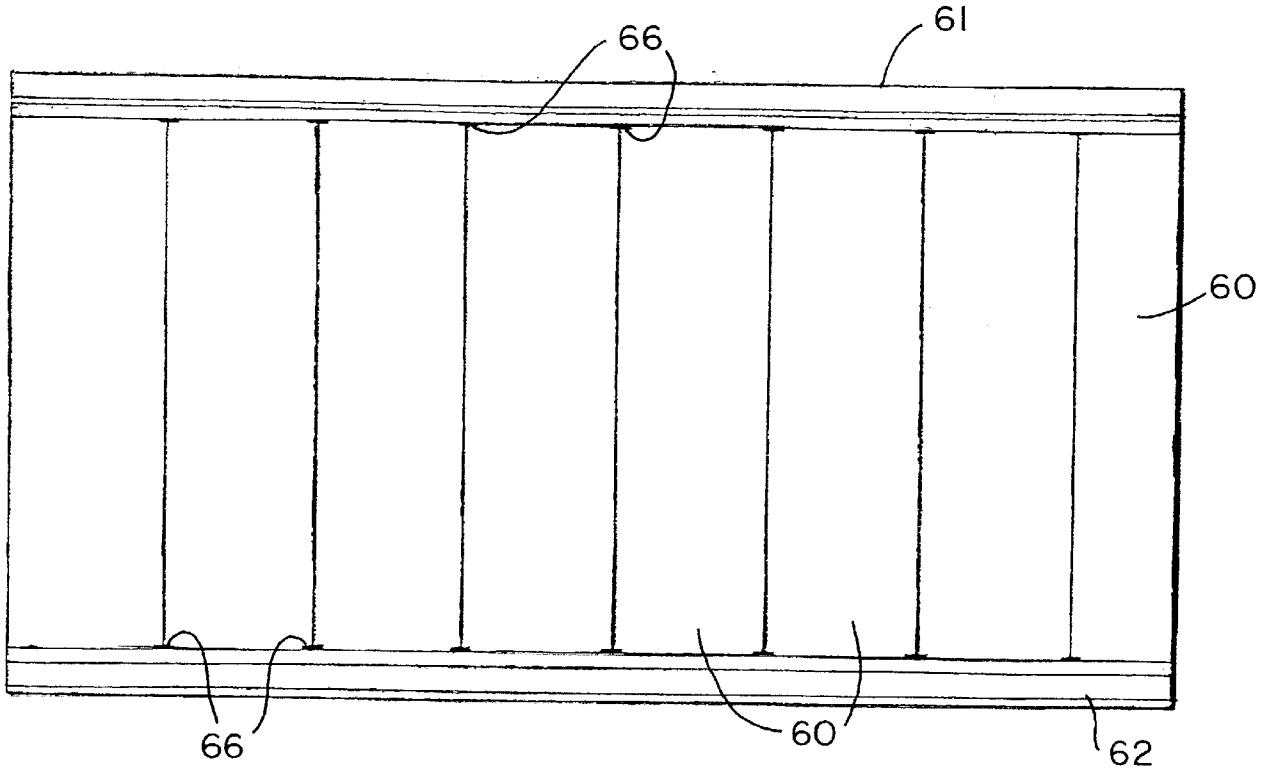
FIG. 13 is a bottom view of the floor deck module of the present invention.

FIG. 13 is a bottom view of a deck section.

Figure 14:
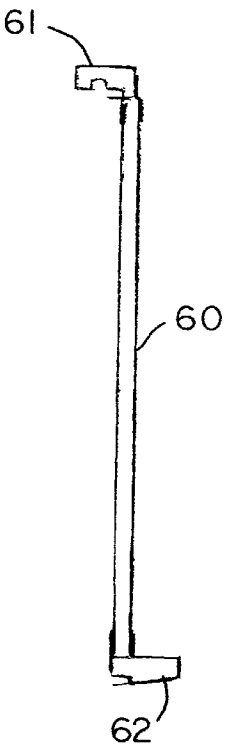
FIG. 14 is an end view of the deck module.

FIG. 14 is an end view. No separate bracing members are required for rigidity. The deck module is a weldment of several extruded aluminum parts. Hollow extruded aluminum planks 60 are fitted in grooves of front extrusion 62 and rear extrusion 61. (Larger views of the profiles of 61 and 62 are shown in FIG. 8.) Planks 60 are stitch welded together 66 and to extrusions 61 and 62 as shown to create a simple rigid lightweight one-piece assembly. The opposite side (not shown) of planks 66 are grooved as part of the extrusion process to form a skid resistant surface for outdoor use. Since there are no weld points on the upper surface, it is totally planar. A clear anodized finish affords abrasion and corrosion resistance. For a quieter surface for indoor use, a mat of rubber or industrial carpet material is adhesively bonded to the top surface of the deck module.

Figure 15:
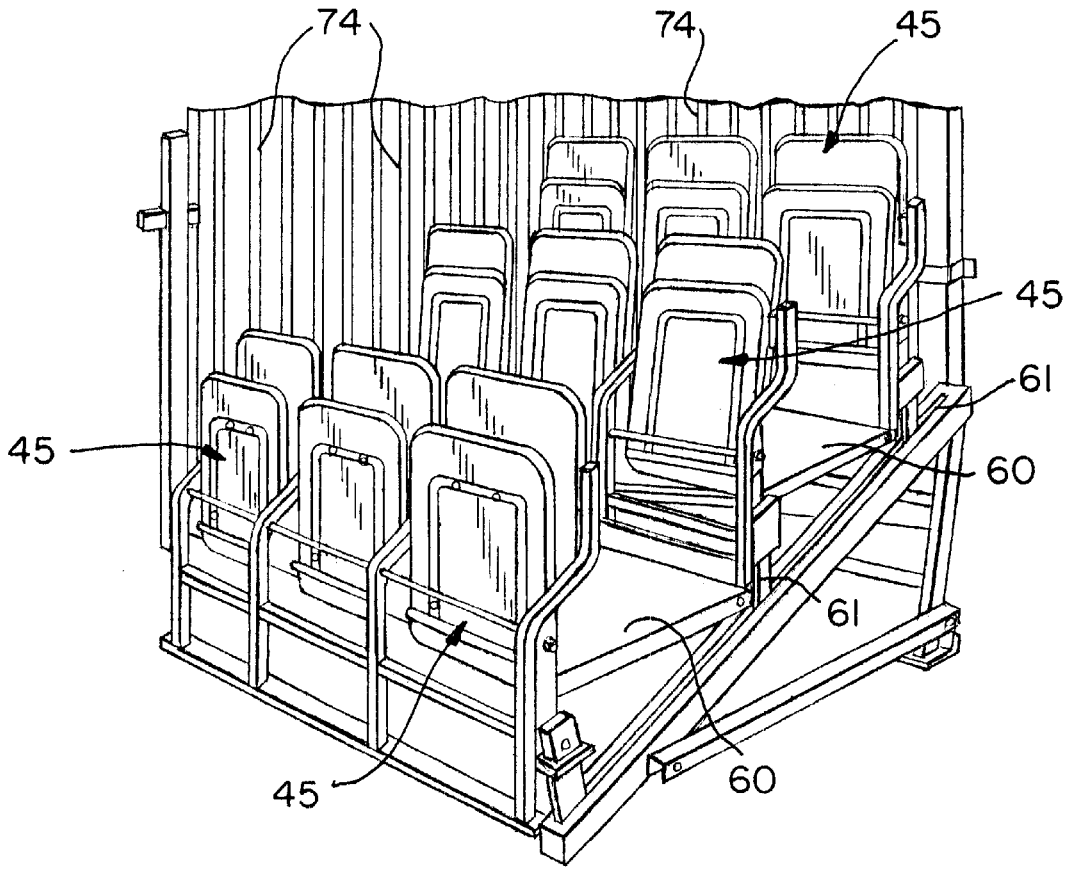
FIG. 15 is a perspective view of the assembled components of the present invention, showing a plurality of seating modules in place.

FIG. 15 shows several three seat modules 45 attached to respective floor deck attachment flanges 61 of decks 60, as well as a plurality of upright handrail picket members 74.

ASSEMBLY AND DISASSEMBLY

The unique indoor/outdoor seating system of the present invention is one of the most innovative and easily demountable seating systems with vandal resistant hardware. This seating system includes a modular structure with easy set up that requires minimal hardware, tools and manpower to assemble. The locking bolt 10 of the present invention, in conjunction with the prior art alignment socket, provide secure tamper-proof connections for the supporting frame structure, due to the unique configuration of the bolt's spring loaded 15 rotating ring tab 4. The preferably aluminum frame is lightweight, strong, non-corrosive and highly suited for interior and exterior use. The assembly of the structure of the present invention uses interlocking channel beams forming the struts that are connected through the use of a single spring loaded locking bolt 10, eliminating excessive nuts, bolts and washers. The independent jack plates are designed for easy leveling adjustments. The brace and tie connections are snap-on, of a tamper-proof design that requires no additional tightening and attaches quickly to the frame, adding rigidity and support. This is the basic foundation of the seating system, which can be accommodated to any floor plan and obtain maximum seat capacity and stay code compliant.

The safety railings 70 of the lateral banister supports exceed code requirements and attach easily with a conventional nut and bolt. Only two bolts are required per each seating section. The balance of each section is locked with a quick pin.

The vertical guides allow for the quick and accurate alignment of the railing use. The floor decking units attach freely to the frame structure when fastened into the set position. Floor decking 60 is available in two styles for interior or exterior use and exceeds all weight load and code requirements.

The modular three chair group sections 45 are easily handled by one person and fastened to the deck without hardware or tools, through the use of conventional spring loaded pins. For permanent installations, resistive cap screws can be substituted.

Conventional seating systems use a 36-inch wide deck to provide the required walk through clearance of 12 inches. The present seating system requires only a 30 inch deck because of the space efficient flip up seats. Fabric seat cushions are easily installed to enhance style and comfort that can be used to designate a general admission or VIP section. Seats can also be upgraded to a theatrical style upholstered chair with a choice of fabric with optional armrest and cup holders to maximize spectator comfort. Seating rows can be spaced on a 6-inch or an optimum 12-inch vertical rise.

The seating system of the present invention can be used in arenas having a tight space confine, such as, for example, in a balcony area in which one wants to put the modular seating groups in. The present invention is also beneficial for areas that are not rectangular in shape, such as where both ends of the seating area are irregular shaped. Therefore, the installer takes the proper measurement and then designs the system that sits into that footprint. By using conventional CAD (computer aided design) systems, the installer can maximize seat count and still be sure that the sponsor is complying with local and safety codes.

The present invention can also be easily installed in inner city arenas which are not very accessible to trucks, or in rough outdoors terrain locations, where there is no drive-in access. With this system of the present invention, the installer's workers can hand carry the components effectively and therefore not be deterred by the fact that one can't drive a truck into the space or where one has to cross a distance of rough terrain land.

The present invention for a seating system is a modular system, basically built in four row units. By using standard four row units, additional multiple units such as with eight and twelve unit rows, all the way up to a large arena system, which has sixty or more row units, can be built.

By using four rows, one has a quick up and down assembly system. Also, the decks can have varying widths.

The seating system of the present invention also has vandal-resistant, spring loaded fasteners 10, such as the locking bolts 10 noted above. The vandal-resistant fasteners 10 eliminate anybody from being able to take the system down without proper tools and proper organization.

If the user is an outdoor sports fan, there can be provided plastic flip up seats. If the user is an indoor theater, there can be provided a theater-style chair that fits into the ultimate seating grandstand system. With that combination, it gives the user maximum number of seats, proper access, aisles brought up to code requirements, stairway exits, ramp ways, or whatever is needed for each user's arena seating needs.

It is further noted that other modifications can be made to the seating system of the present invention, without departing from the scope of the invention, as noted in the appended claims.

We claim:

1. An indoor/outdoor seating system of at least one seating module of spectator seats, which system can be assembled and disassembled efficiently while providing an attractive, safe and comfortable seating area for a wide variety of spectator events, comprising:

a plurality of lower hollow post sections insertable within upper hollow post sections, said lower hollow post sections having longitudinally extending grooves accommodating the head of at least one locking bolt therethrough, said joined post sections supporting at least one floor board deck member having at least one attachment extrusion flange extending therefrom, said at least one attachment extrusion flange supporting at least one of said seating modules thereon; and, said seating system having at least one safety handrail banister at an edge thereof, wherein said at least one locking bolt has a rotating cam ring shoulder portion out of alignment with a shaft, a spring having a first portion bearing against said shaft, and a second portion moving said rotating cam ring shoulder portion bearing against an inner surface of a center hole in said ring.

2. The system as in claim 1 wherein said locking bolt is assembled by threading an end cap onto a threaded extension.

3. The system as in claim 1 wherein said locking bolt is a shortened locking stud pre-attached to a structural member.

4. The system as in claim 1 further comprising for irregular terrain, a base jack with a base flange, an attached screw accommodating extension sleeve, said extension sleeve being rested on a collar of said base jack, which said extension sleeve is then height adjusted by a jack nut.

5. The system as in claim 1 wherein said at least one seating module is connected to adjacent upper and lower floor decks, said upper floor deck being located above and behind said lower floor deck in said seating system, each said floor deck having respective front and rear grooved attachment extrusions extending therefrom, said seating module having a lower flange with a hole therethrough for inserting a fastener therethrough for holding said lower flange of said seating module within a groove of said rear attachment extrusion of said lower floor deck for mounting at least one seat module to said lower floor deck, said seating module being fitted so that said rear flange is aligned within said groove in said attachment extrusion of said lower floor deck, said seating module further having an upper flange insertable in a groove of said front grooved attachment extrusion of said next subsequent upper floor deck situated behind and above said lower floor deck, said lower flange of said seating module being simultaneously dropped into said groove in said rear attachment extrusion of said lower floor deck and said upper flange being simultaneously dropped into said groove in said front attachment extrusion of said next, subsequent upper floor deck, wherein when said fastener is inserted within said lower flange of said seating module, said seating module is locked in place to said lower floor deck, thereby simultaneously locking both said upper and said lower decks to one another.

6. The system as in claim 5 wherein said fastener is a locking pin being guided by a key ring, wherein when said key ring is released, said seating module is locked in place to said lower floor deck, thereby simultaneously locking both said upper and lower floor decks to one another.

7. The system as in claim 5 wherein said fastener is a button cap screw, said button screw cap being threaded through a tapped fixing plate and a threaded barrel at its end, said length of said cap screw and said barrel being selected such that when torqued down, said seating module is securely locked in the groove of said rear floor deck extrusion.

8. The system as in claim 1 wherein said at least one safety rail includes a plurality of vertically extending picket elements, joined by a bottom rail and an upper handrail, said upper handrail having ergonomically configured gripping grooves forming a gripping surface for the hand of a user, and said picket members being polygonal in cross section to resist bending or denting from lateral side impacts.

9. The system as in claim 8 wherein said picket elements and said safety rails are manufactured of aluminum.

10. The system as in claim 9 wherein said aluminum polygonal posts have a longer longitudinal axis than a transverse axis, providing a bending moment resistance in a structural profile having a significantly less material thickness than thickness of a member of round cross section of equivalent strength.

11. An indoor/outdoor seating system of at least one seating module of spectator seats, which system can be assembled and disassembled efficiently while providing an attractive, safe and comfortable seating area for a wide variety of spectator events, comprising:

a plurality of lower hollow post sections insertable within upper hollow post sections, said lower hollow post sections having longitudinally extending grooves accommodating the head of at least one locking bolt therethrough, said joined post sections supporting at least one floor board deck member having at least one attachment extrusion flange extending therefrom, said at least one attachment extrusion flange supporting at least one of said seating modules thereon; and, said seating system having at least one safety handrail banister at an edge thereof, wherein said floor board deck includes a plurality of hollow planks fitted in respective grooves of adjacent front extrusions and rear extrusions, said planks being welded together to said extrusions to create a rigid light-weight one-piece assembly, said planks having an upper skid resistant surface.

12. The system as in claim 11 further comprising for irregular terrain, a base jack with a base flange, an attached screw accommodating extension sleeve, said extension sleeve being rested on a collar of said base jack, which said extension sleeve is then height adjusted by a jack nut.

13. The system as in claim 11 wherein said at least one seating module is connected to adjacent upper and lower floor decks, said upper floor deck being located above and behind said lower floor deck in said seating system, each said floor deck having said respective front and rear grooved attachment extrusions extending therefrom, said seating module having a lower flange with a hole therethrough for inserting a fastener therethrough for holding said lower flange of said seating module within a groove of said rear attachment extrusion of said lower floor deck for mounting at least one seat module to said lower floor deck, said seating module being fitted so that said rear flange is aligned within said groove in said attachment extrusion of said lower floor deck, said seating module further having an upper flange insertable in a groove of said front grooved attachment extrusion of said next subsequent upper floor deck situated behind and above said lower floor deck, said lower flange of said seating module being simultaneously dropped into said groove in said rear attachment extrusion of said lower floor deck and said upper flange being simultaneously dropped into said groove in said front attachment extrusion of said next, subsequent upper floor deck, wherein when said fastener is inserted within said lower flange of said seating module, said seating module is locked in place to said lower floor deck, thereby simultaneously locking both said upper and said lower decks to one another.

14. The system as in claim 13 wherein said fastener is a locking pin being guided by a key ring, wherein when said key ring is released, said seating module is locked in place to said lower floor deck, thereby simultaneously locking both said upper and lower floor decks to one another.

15. The system as in claim 13 wherein said fastener is a button cap screw, said button cap screw being threaded through a tapped fixing plate and a threaded barrel at its end, said length of said cap screw and said barrel being selected such that when torqued down, said seating module is securely locked in the groove of said rear floor deck extrusion.

16. The system as in claim 11 wherein said at least one safety rail includes a plurality of vertically extending picket elements, joined by a bottom rail and an upper handrail, said upper handrail having ergonomically configured gripping grooves forming a gripping surface for the hand of a user, and said picket members being polygonal in cross section to resist bending or denting from lateral side impacts.

17. The system as in claim 16 wherein said picket elements and said safety rails are manufactured of aluminum.

18. The system as in claim 16 wherein said aluminum polygonal posts have a longer longitudinal axis than a transverse axis, providing a bending moment resistance in a structural profile having a significantly less material thickness than thickness of a member of round cross section of equivalent strength.

19. A locking bolt for an indoor/outdoor seating system of at least one seating module of spectator seats, which system can be assembled and disassembled efficiently while providing an attractive, safe and comfortable seating area for a wide variety of spectator events, said seats supported by a plurality of hollow post sections joined to other hollow post sections by said locking bolt, said joined post sections supporting at least one floor board deck member having at least one attachment extrusion flange extending therefrom, said at least one attachment extrusion flange supporting at least one of said seating modules thereon;

said locking bolt comprising a rotating cam ring shoulder portion out of alignment with a shaft, a spring having a first portion bearing against said shaft, and a second portion moving said rotating cam ring shoulder portion bearing against an inner surface of a center hole in said ring.

20. A floor deck for an indoor/outdoor seating system of at least one seating module of spectator seats, which system can be assembled and disassembled efficiently while providing an attractive, safe and comfortable seating area for a wide variety of spectator events, said seating system having a plurality of hollow post sections joined to other hollow post sections, said joined post sections supporting at least one floor board deck member having at least one attachment extrusion flange extending therefrom, said at least one attachment extrusion flange supporting at least one of said seating modules thereon; and, said floor board deck comprising a plurality of hollow planks fitted in respective grooves of adjacent front extrusions and rear extrusions, said planks being welded together to said extrusions to create a rigid light-weight one-piece assembly, said planks having an upper skid resistant surface.

* * * * *